US005349510A

United States Patent [19]

Jordan et al.

[11] Patent Number: 5,349,510

[45] Date of Patent: Sep. 20, 1994

[54] SPRING LATCHING MECHANISM FOR LIGHT FIXTURE

[75] Inventors: David L. Jordan, Boones Mill; Marc A. Schetselaar, Christiansburg, both of Va.

[73] Assignee: Hubbell Incorporated, Orange, Conn.

[21] Appl. No.: 855,669

[22] Filed: Mar. 23, 1992

[51] Int. Cl.[5] ..... F21V 17/00

[52] U.S. Cl. ..... 362/374; 362/375; 362/457; 292/87

[58] Field of Search ..... 362/311, 368, 370, 371, 362/374, 375, 396, 455, 457; 292/80, 87, 246

[56] References Cited

U.S. PATENT DOCUMENTS

| | | | |
|---|---|---|---|
| 1,175,603 | 3/1916 | Clausen | 292/87 |
| 1,283,480 | 11/1918 | Duffy . | |
| 1,301,994 | 4/1919 | Archer et al. . | |
| 1,389,013 | 8/1921 | Schwartz . | |
| 1,648,167 | 11/1927 | Donley | 362/374 |
| 2,107,906 | 2/1938 | Rogers | 240/41 |
| 2,305,432 | 12/1942 | Kupfermann et al. | 292/87 |
| 2,810,599 | 10/1957 | Hardy | 292/DIG. 50 |
| 2,967,230 | 1/1961 | Goetz et al. | 240/3 |
| 3,069,541 | 12/1962 | Thomsen et al. | 292/87 |
| 3,070,691 | 12/1962 | Relich | 362/374 |
| 3,246,135 | 4/1966 | Husby | 240/3 |
| 3,519,811 | 7/1970 | Jacobs | 240/3 |
| 3,694,015 | 9/1972 | Gley | 292/80 |
| 3,888,525 | 6/1975 | Kousens | 292/87 |
| 4,349,865 | 9/1982 | Terrel | 362/250 |
| 4,380,792 | 4/1983 | Terrell | 362/250 |
| 4,405,974 | 9/1983 | Quiogue | 362/362 |
| 4,516,196 | 5/1985 | Blake | 362/374 |
| 4,517,632 | 5/1985 | Roos | 362/389 |
| 4,654,768 | 3/1987 | Dryman et al. | 362/374 |
| 4,722,502 | 2/1988 | Mueller et al. | 248/284 |
| 4,782,435 | 11/1988 | Manzoni | 362/427 |
| 4,785,190 | 11/1988 | Frankena | 250/503.1 |
| 4,811,923 | 3/1989 | Haberthür | 248/278 |
| 5,025,358 | 6/1991 | Cannell | 362/310 |

FOREIGN PATENT DOCUMENTS

| | | | |
|---|---|---|---|
| 715941 | 12/1941 | Fed. Rep. of Germany | 362/396 |
| 2415525 | 10/1975 | Fed. Rep. of Germany | 362/455 |
| 2618564 | 11/1977 | Fed. Rep. of Germany . | |
| 2939910 | 4/1965 | Netherlands | 362/374 |
| 381320 | 10/1964 | Switzerland | 362/223 |
| 1181796 | 2/1970 | United Kingdom | 362/473 |

*Primary Examiner*—Ira S. Lazarus
*Assistant Examiner*—Y Quach
*Attorney, Agent, or Firm*—Jerry M. Presson; Mark S. Bicks

[57] ABSTRACT

A light fixture including a housing having a longitudinal axis, an open axial end, and a lens door assembly pivotally connected to the housing and permitting the lens door assembly to move between an open position and a closed position. A latch mechanism secures the lens door assembly in the closed position over the open end of the housing. The latch mechanism can include at least one spring clip connected to the housing and engaging a tab of the lens door assembly when in the closed position.

17 Claims, 5 Drawing Sheets

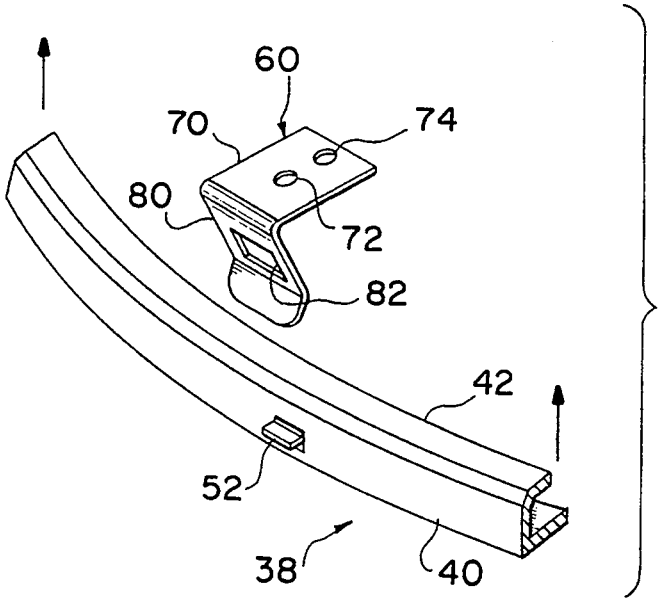
FIG. 6
FIG.7
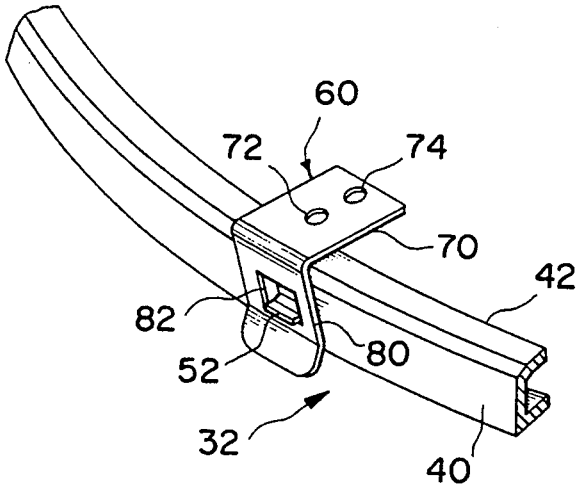
FIG. 8
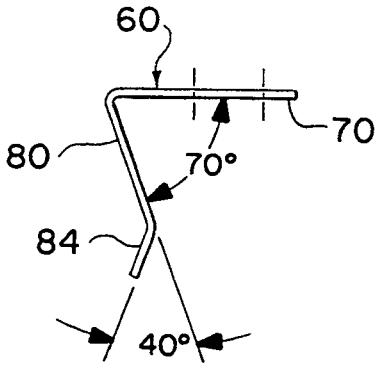

SPRING LATCHING MECHANISM FOR LIGHT FIXTURE

FIELD OF THE INVENTION

The present invention relates to a light fixture having a spring latching mechanism for securing a lens door assembly of the light fixture in a closed position. More particularly, the invention relates to a spring clip which cooperates with tabs to provide positive securement of the lens door assembly in the closed position relative to the housing.

BACKGROUND OF THE INVENTION

For certain types of light fixtures, it is desirable to pivotally attach a lens door assembly to the front end of a housing so that the lens door assembly can be pivoted between an open position and a closed position. In the open position, access can be gained to an optical enclosure within the housing. A suitable light producing element is mounted in the optical enclosure for emitting light through the lens door assembly.

Conventionally, the lens door assembly is latched in a closed position using pivoting-type latches. A pivoting-type latch usually employs a pivotal member which pivots over the peripheral edge of the lens door assembly at an area remote from the hinge, or at multiple locations remote from the hinge using a plurality of pivotal members.

Generally, pivoting-type latches do not provide positive securement of the lens door assembly. The pivoting member itself, if not latched with a separate latching mechanism, can inadvertently move to disengage the peripheral edge of the lens door assembly, inadvertently opening and damaging to the lens of the lens door assembly.

Positive securement is particularly desirable when the housing is movably mounted to attain various orientations of the housing and thus the lens, particularly where the lens door assembly is inverted or tilted beyond 90°. In those orientations, the lens door assembly would pivot open if the latch mechanism fails inadvertently disengages.

An example of a prior latching mechanism is disclosed in U.S. Pat. No. 4,405,974 to Quiogue.

Thus, a continuing need exists for an improved latching mechanism which provides positive securement of a lens door assembly in a closed position.

SUMMARY OF THE INVENTION

Accordingly, an object of the present invention is to provide a light fixture which has a latching mechanism capable of positively securing a lens door assembly in the closed position.

Another object of the present invention is to provide a latching mechanism for a light fixture which is relatively simple in construction and cost effective to produce.

A further object of the present invention is to provide a latching mechanism for a light fixture in which complementary components are disposed on the housing and on the lens frame assembly to provide positive securement of the lens door assembly in the closed position, while at the same time providing a simple and easy way to release the positive securement, when desired, to permit opening of the lens door assembly.

The foregoing objects are obtained by a light fixture comprising a housing having a longitudinal axis, an open axial end, a light coupling disposed within the housing, a lens door assembly including a lens mounted in a lens frame, hinge means for pivotally connecting the lens door assembly to the housing and permitting the lens door assembly to move between an open position and a closed position, and latch means for securing the lens door assembly in the closed position over the open end of the housing. The latch means includes at least one spring clip connected to the housing or the lens door assembly and engaging the other of the housing and the lens door assembly when in the closed position.

Preferably, the spring clip has a second leg, integral with the first leg, which forms a base for mounting the spring clip on the flange of the housing. The first leg is angled towards the longitudinal axis of the housing and has a distal end which angles away from the longitudinal axis of the housing. An aperture formed in the first leg engages a tab extending radially outwardly from the lens frame when the lens door assembly is in the closed position to provide positive securement of the lens frame assembly in the closed position.

Other objects, advantages and salient features of the present invention will become apparent from the following detailed description which, taken in conjunction with the annexed drawings, discloses a preferred embodiment of the invention.

BRIEF DESCRIPTION OF THE DRAWINGS

Referring to the drawings which form a part of this disclosure:

FIGS. 2(*a*), 2(*b*) and 2(*c*) are side elevational, end and top plan views, respectively, of a first hinge plate of a hinge pivotally connecting the lens door assembly to the housing;

FIGS. 2(*d*), 2(*e*) and 2(*f*) are side elevational, end and top plan views, respectively, of a second hinge plate of the hinge;

FIG. 6 is a partial perspective view showing the portion of the lens frame and a corresponding spring clip latching mechanism of the present invention, in an unlatched position;

FIG. 7 is a partial perspective view similar to FIG. 6, with the spring clip and lens frame in a latched closed position; and FIG. 8 is a side elevational view of the spring clip of the present invention.

DETAILED DESCRIPTION OF THE INVENTION

Figure 1:
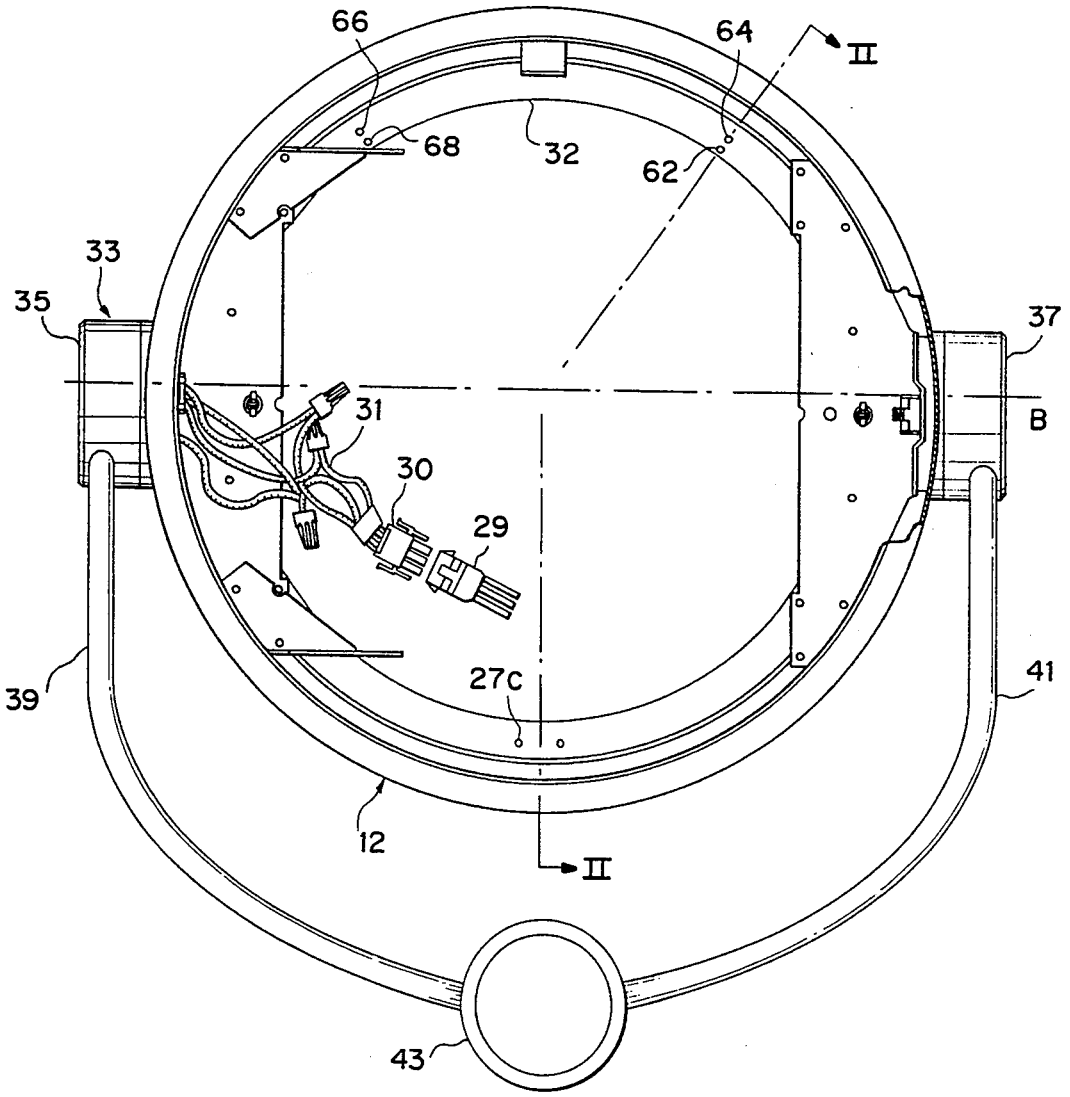
FIG. 1 is a plan view of a housing of a light fixture according to the present invention with the lens door assembly removed to illustrate the interior of the housing.

Referring now to the drawings, a light fixture 10 according to the present invention includes a housing 12 having a longitudinal axis "A", a rear end 14 and a front end 16. The rear end 14 is closed by a cover 18 (partially shown in FIG. 2) coupled to a flange 20 formed on the rear end 14 of the housing 12 by retainer springs 22, with a seal 24 disposed therebetween to define an optical enclosure 26.

Figure 2:
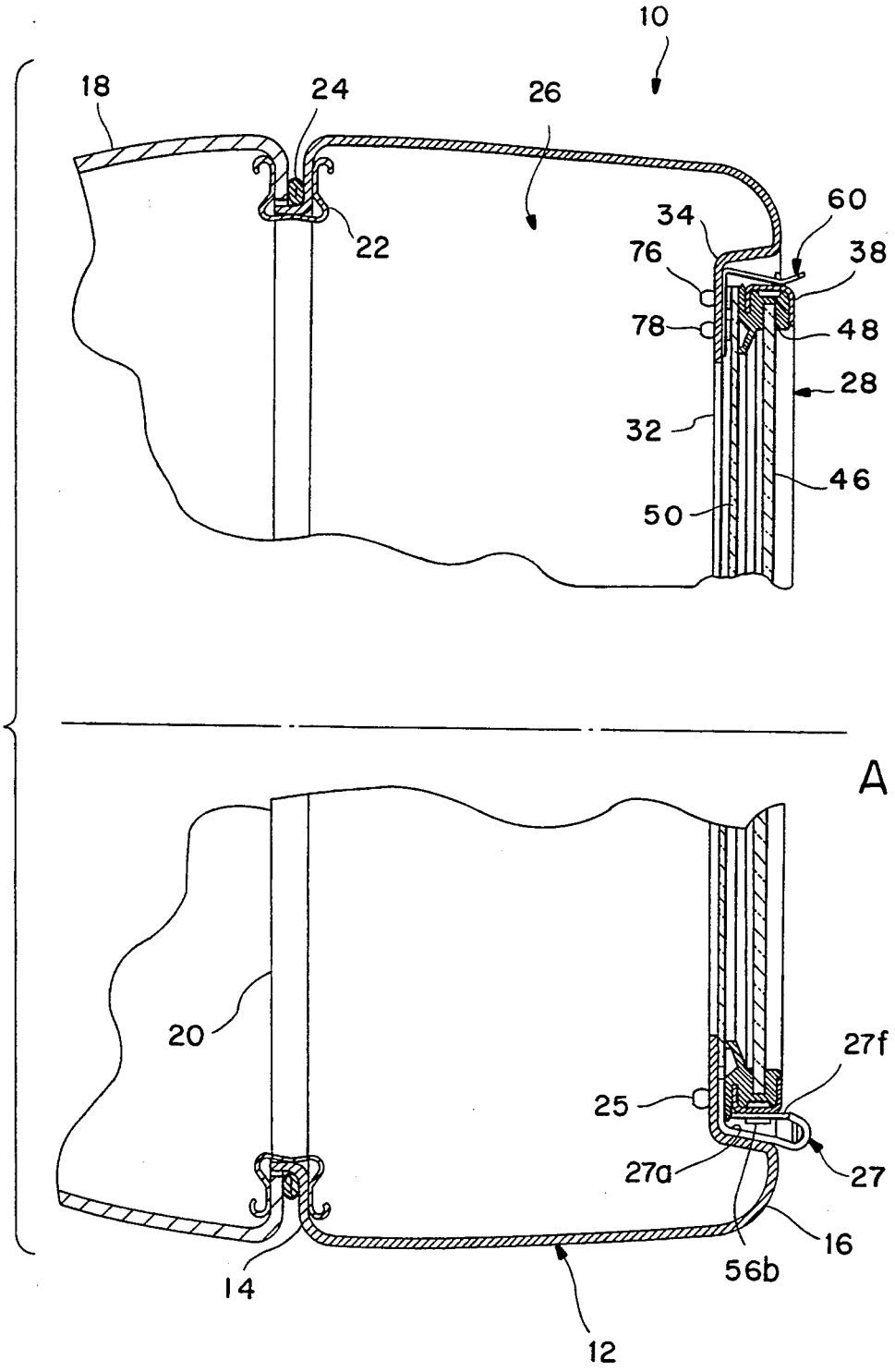
FIG. 2 is an enlarged, partial side elevational view, in section along line II—II of FIG. 1, of the light fixture according to the present invention, with the lens door assembly installed and positioned in a latched closed position.
Figure 2A:
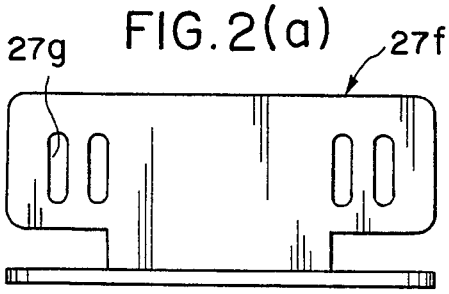
Figure 2B:
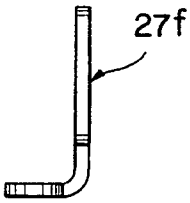
Figure 2C:
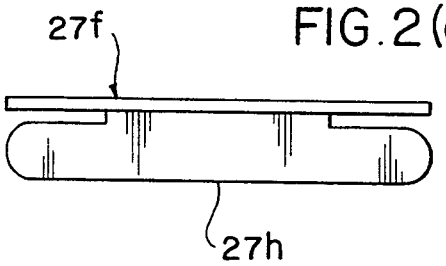
Figure 2D:
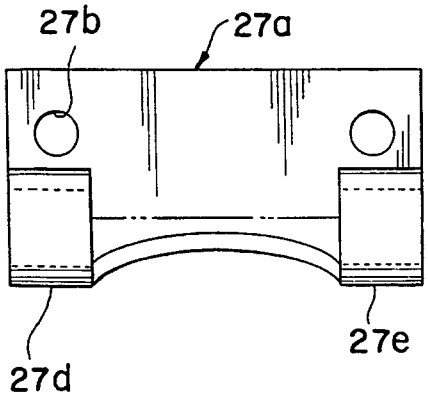
Figure 2E:
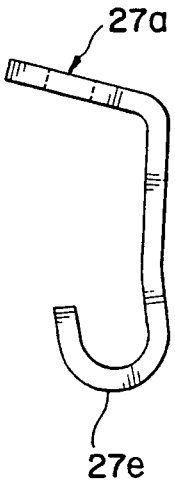
Figure 2F:
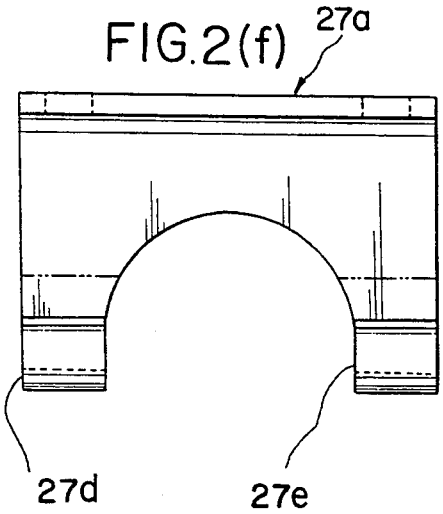

The light fixture 10 emits light from front end 16 through a lens door assembly 28. Assembly 28 is pivotally connected to the front end 16 of the housing 12 by a hinge 27 for pivotal movement about a pivot axis substantially perpendicular to the longitudinal axis A of the housing. As a result, the lens door assembly 28 can be pivoted between a closed position, as seen in FIG. 2, and an open position allowing access to the enclosure 26. Any suitable light producing element (not shown) can be mounted in the enclosure 26 using appropriate mounting means such as a wiring quick disconnect 29 and a light coupling 30. The light coupling 30 can be any suitable structure which is coupled through wires 31 to a source of electrical energy. Other light sockets or other suitable electrical connectors may be employed. Moreover, any suitable light reflective structures (not shown) may be mounted in the enclosure 26.

A support structure 33 coupled to the housing 12 supports the light fixture 10 in a desired orientation. Details of this structure are described in U.S. patent application Ser. No. 07/725,485 filed Jul. 3, 1991, the subject matter of which is hereby incorporated herein by reference. Briefly, the support structure 33 includes two identical casings 35 and 37 which permit the housing 12 to pivot about a pivot axis "B". Cantilever spokes 39 and 41 have distal ends coupled respectively to the casings 35 and 37, and proximal ends connected to a mounting post 43. The housing 12 may thus be supported so that its longitudinal axis A is fixed in a horizontal orientation as shown in FIG. 2, or the orientation may be varied by rotating the housing 12 about the pivot axis B.

In the illustrated embodiment, the housing 12 is generally annular in shape and is stamped or otherwise formed of suitable material, such as aluminum. The front end 16 includes a recessed annular flange 32 against which the lens door assembly 28 closes. The flange 32 is the radial inward extension of an annular step formation 34 at the front end 16 of the housing 12. The step formation 34 allows the lens door assembly 28, when seated in the closed position, to be nearly flush with the front end 16. The flange 32 defines a circular opening 36 which is closed by the lens door assembly 28.

The lens door assembly 28 includes a lens frame 38 which is generally U-shaped in cross section, and has a side wall 40, a front flange 42, and a rear flange 44. Both flanges 42 and 44 are integral with the side wall 40. Preferably, the lens frame 38 is substantially annular in shape and has two juxtaposed ends **38*a* and 38*b* which, prior to assembling the other components of the lens door assembly, can be pulled apart vertically and/or horizontally to facilitate mounting of the lens 46** therein.

Prior to mounting the lens 46 in lens frame 38, an elastomeric seal 48 is placed inside the lens frame 38. The peripheral edge of the lens 46 is then fitted into an annular groove of the seal 48. A reflector assembly ring 50, or other type of element, may be positioned between the inner surface of the seal 48 and the flange 32 of the housing 12 and may simply contact the seal or may be attached thereto by suitable means. Lens 46 can be clear lime glass, heat and impact tempered, and 92% light transmissive, for example. While lenses are preferred for the light fixture described herein, non-optically powered translucent members may be employed instead. Thus, the term "lens" is intended to broadly refer to various types of optical and/or translucent members.

The lens frame 38 includes a pair of identical tabs 52 and 54, each of which extends radially outwardly from the side wall 40, in a direction opposite and substantially parallel to the flanges 42 and 44. The tabs 52 and 54 are equi-angularly spaced with respect to the hinge 27, and may be formed by stamping. A hole **54*a* is formed where the tab 54 projects outwardly, since preferably the tabs are cut from the side wall 40. The lens frame 38 further includes a pair of arms 56*a* and 56*b*, each of which project radially outwardly perpendicular to the flanges 42 and 44**.

Figure 3:
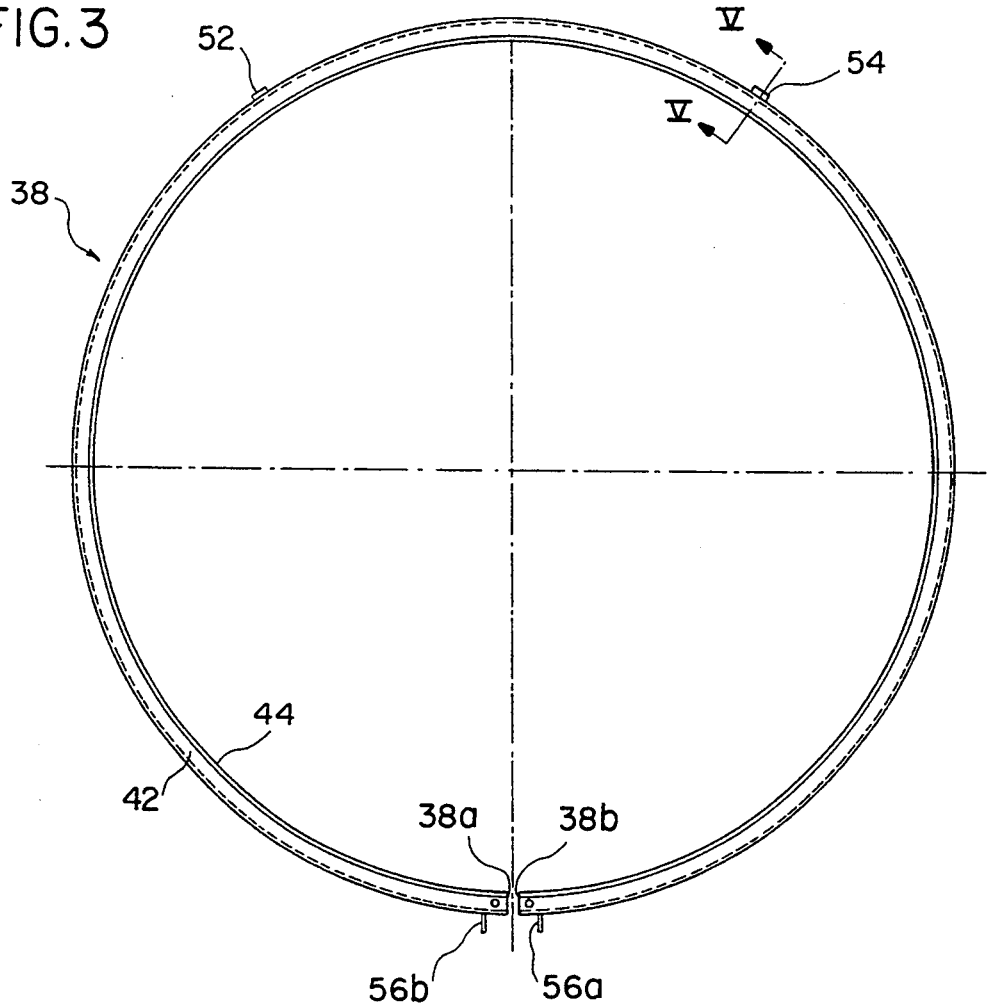
FIG. 3 is a plan view of a lens frame of the lens door assembly of FIG. 2.
Figure 4:
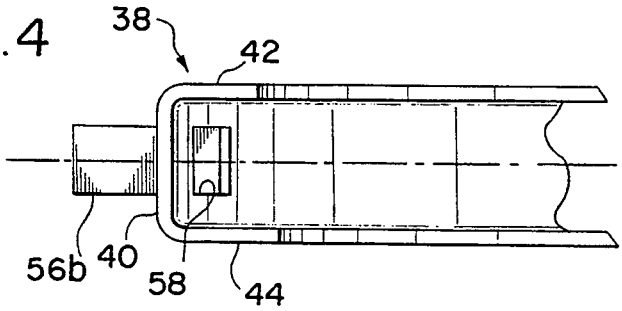
FIG. 4 is an enlarged, partial end view of the lens frame of FIG. 3.
Figure 5:
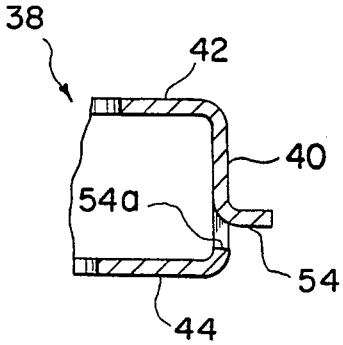
FIG. 5 is a partial side elevational view in section along line V—V of FIG. 3.

The hinge 27 pivotally connects the lens door assembly 28 to the housing and permits the assembly to move between an open position and a closed position. Referring to FIGS. 2 and **2(*a*)–2(*f*), hinge 27 includes a first hinge plate 27*a* which is connected by rivets 25 to the flange 32 of the housing 12. A pair of holes 27*b* formed in a base of the hinge plate 27*a* align with a pair of holes 27*c* formed in the flange 32 to receive the rivets 25. The first hinge plate 27*a* includes a pair of arcuate support arms 27*d* and 27*e* which pivotally mount a pivot pin of a second hinge plate 27*f*. The second hinge plate 27*f* has a base portion which includes a plurality of elongated openings 27*g*, arranged as an outer pair and an inner pair. When the lens door assembly is assembled, the pair of arms 56*a* and 56*b* (see FIG. 3) of the lens frame 38 are received in the pair of elongated openings 27*g* providing the best fit. Arms 56*a* and 56*b* are then bent over 90° to lock the lens frame 38 and second hinge plate 27*f* together. The second hinge plate 27*f* includes an integral pivot pin 27*h* extending outwardly at a right angle from the base. The pivot pin 27*h* is slidably received between the support arms 27*d* and 27*e* of the first hinge plate 27*a*, thus permitting pivotal movement of the lens door assembly. Other suitable hinge structures may be employed. Since the arms 56*a* and 56*b* are also preferably stamped or otherwise formed from the lens frame, a hole 58 (FIG. 4) is formed in the side wall 40** adjacent each leg.

A latching mechanism according to the present invention is used to secure the lens door assembly 28 in the closed position. The latching mechanism includes a pair of spring clips 60, each of which is fixedly connected to the flange 32 of the housing 12 by use of any conventional mounting or connecting means. In the preferred embodiment, a pair of holes 62 and 64 are formed in the flange 32 for mounting one spring clip 60 at a position to engage one tab 52 of the lens frame 38 when in the closed position. Similarly, a pair of holes 66 and 68 are provided in the flange 32 at a position for mounting the second spring clip 60 to engage the other tab 54 when the lens frame 38 is in the closed position. The two pairs of holes receive rivets or other fastener means which fixedly connect the spring clips 60 to the flange 32.

Referring to FIGS. 6–8, each spring clip 60 has a leg 70 having a pair of holes 72 and 74 aligned with respective pairs of holes 62, 64 and 66, 68 for receiving rivets 76 and 78, respectively, thereby fixedly connecting each spring clip 60 to the housing 12. Of course, other suitable fastener means may be used, including other fasteners, welds, adhesive, etc.

A leg 80 is integral with the leg 70 and angled with respect to the leg 70 preferably at an acute angle of about 70°. The leg 80 has an aperture or opening 82 formed therein for receiving a corresponding one of the tabs 52 and 54 of the lens frame 38. A distal end 84 of the leg 80 is angled away from the longitudinal axis of the housing, preferably at about 40° relative to a continuation of the proximal end portion of the leg 80. The angled distal end 84 helps guide the lens door assembly 28 into the closed position and provides a cam surface over which the lens frame 38 slides to flex the leg 80 radially outwardly with respect to the longitudinal axis A of the housing 12. The radial outward flexing of the leg creates a spring bias forcing the leg 80 towards and against the lens frame 38.

The lens door assembly 28 is latched closed with positive securement provided by the tabs 52 and 54 being received in and engaging corresponding openings 82 of the spring clips 60. Once the openings and tabs engage each other, the lens door assembly cannot be opened unless the leg 80 of each spring clip 60 is forced radially outwardly by hand to a point where the tabs clear the openings. Thus, while the leg 80 is held radially outwardly to clear the tabs 52 and 54, the lens door assembly 28 can be pivoted to the open position.

Different numbers and arrangements of the spring clips can be employed. If one spring 60 is used, the clip and mating tab should be positioned diametrically opposite the hinge 27. A number of spring clips greater than two may also be employed and, if so, they should preferably be equidistantly spaced around the perimeter. Of course, an equal number of tabs will be provided for the selected number of spring clips. Regardless of the number, each spring clip as preferably made of metal and is formed by stamping.

The latching mechanism of the present invention employs complementary components which interfit to provide a positive securement. Thus, the spring clip could be mounted on the lens frame assembly to engage the housing. Also, the position of the tab and hole could be reversed, so that the tab could extend from the spring clip to be received in the hole in the housing or the lens door assembly. The spring clip could have a simplified structure in which, for example, a spring arm is formed integral with the housing by stamping. A spring force is then developed where the arm bends relative to the housing. Conversely, the spring arm could be formed integral with the lens frame in the same manner.

While a specific embodiment has been chosen to illustrate the invention, it will be understood by those skilled in the art that various changes can be made therein without departing from the scope of the invention as defined in the appended claims.

What is claimed is:

1. A light fixture, comprising:

a housing having a longitudinal axis, and an open axial end;

a lens door assembly including a lens mounted in a lens frame;

hinge means for pivotally connecting the said door assembly to said housing and permitting said lens door assembly to move between an open position and a closed position; and latch means for securing the lens door assembly in the closed position over said open axial end of said housing, said latch means including a spring clip connected to said housing and engaging the lens door assembly when in the closed position, said spring clip including a first leg and a second leg, said first leg extending axially from the housing at an acute angle towards the longitudinal axis of the housing and being oriented to flex radially outwardly to receive and then engage the lens frame when the lens door assembly is in the closed position, said second leg being integral with the first leg and being fixedly connected to the housing perpendicularly with respect to the longitudinal axis of the housing, said first leg including an aperture, said lens frame including a radially outwardly extending tab which is received in and detachably engages the aperture of the first leg when the lens door assembly is in the closed position.

2. A light fixture according to claim 1, wherein the housing includes a substantially annular side wall and a flange at a front end of the housing, said flange being perpendicular to the longitudinal axis of the housing; and said second leg of said spring clip is fixedly connected to said flange of said housing.

3. A light fixture according to claim 1, wherein the lens frame is substantially annular; and the latch means includes first and second spring clips, the first and second spring clips being disposed opposite the hinge means at equi-angular positions with respect to the hinge means.

4. A light fixture, comprising:

a housing having a longitudinal axis and an open axial end;

a door assembly including a translucent member mounted in a frame;

hinge means for pivotally connecting said door assembly to said housing and permitting said door assembly to move between an open position and a closed position; and latch means for securing said door assembly in the closed position over said open axial end of said housing, said latch means including a spring clip connected to said housing and releasably engaging said door assembly when in the closed position, said spring clip including a first leg extending axially outwardly from said housing at an acute angle towards said longitudinal axis in the closed position and being oriented to flex radially outwardly and thereby to receive and then engage said door assembly during closing, said first leg having a distal end portion acutely angled away from said longitudinal axis in the closed position, said distal end portion providing a cam surface which bears against said door assembly during closing, said latch means including mating detent means on said first leg of said spring clip and said door assembly, said detent means comprising an aperture and a tab to be received in said aperture in the closed position.

5. A light fixture according to claim 4, wherein said spring clip is connected to said housing for releasably engaging said door assembly when in the closed position.

6. A light fixture according to claim 4, wherein said spring clip comprises a second leg integral with said first leg, said second leg being substantially normal with respect to said longitudinal axis in the closed position.

7. A light fixture according to claim 4, wherein said aperture is formed in said first leg of said spring clip.

8. A light fixture according to claim 4, wherein said housing includes an annular side wall and a flange integral with said annular side wall and disposed at said open axial end, said flange being substantially perpendicular to said longitudinal axis.

9. A light fixture according to claim 8, wherein said spring clip comprises a second leg fixedly connected to said flange of said housing.

10. A light fixture according to claim 4, wherein said latch means includes first and second spring clips, each of said spring clips including a first leg attached to and extending axially from said housing at an acute angle towards said longitudinal axis and being oriented to flex radially outwardly and thereby to receive and then engage said frame when said door assembly is moved to the closed position.

11. A light fixture according to claim 10, wherein said frame is circular and said first and second spring clips are disposed opposite said hinge means.

12. A light fixture, comprising:

a housing having a longitudinal axis, an open axial end, an annular side wall and a flange integral with said annular side wall and disposed at said open axial end, said flange being substantially perpendicular to said longitudinal axis;

a door assembly including a translucent member mounted in a frame;

hinge means for pivotally connecting said door assembly to said housing and permitting said door assembly to move between an open position and a closed position; and latch means for securing said door assembly in the closed position over said open axial end of said housing, said latch means including a spring clip fixedly connected to said flange of said housing and releasably engaging said door assembly when in the closed position, said spring clip including a first leg extending axially outwardly from said housing at an acute angle towards said longitudinal axis and being oriented to flex radially outwardly and thereby to receive and then engage said door assembly during closing, said latch means including an aperture and a tab formed in and extending radially from said door assembly and said first leg of said spring clip, said tab being received in said aperture in the closed position.

13. A light fixture according to claim 12, wherein said spring clip comprises a second leg integral with said first leg, said second leg being substantially normal with respect to said longitudinal axis and connected to said flange.

14. A light fixture according to claim 12, wherein said aperture is formed in said first leg of said spring clip and said tab extends radially outwardly from said door assembly.

15. A light fixture according to claim 12, wherein said latch means includes first and second spring clips, each of said spring clips including a first leg extending axially from said housing at an acute angle towards said longitudinal axis and being oriented to flex radially outwardly and thereby to receive and then engage said frame when said door assembly is moved to the closed position.

16. A light fixture according to claim 15, wherein said frame is circular and said first and second spring clips are disposed opposite said hinge means.

17. A light fixture, comprising:

a housing having a longitudinal axis and an open axial end;

a door assembly including a translucent member mounted in a frame;

coupling means for connecting said door assembly to said housing and permitting said door assembly to move between an open position and a closed position; and latch means, on said housing and said door assembly, for securing said door assembly in the closed position over said open axial end of said housing, said latch means including a spring clip, said spring clip including a first leg extending axially outwardly relative to said housing at an acute angle towards said longitudinal axis in the closed position and being oriented to flex radially outwardly during closing, said first leg having a distal end portion acutely angled away from said longitudinal axis in the closed position, said distal end portion providing a cam surface, said latch means including mating detent means on said first leg of said spring clip and a mating part of said housing and said door assembly, said detent means comprising an aperture and a tab to be received in said aperture in the closed position.

* * * * *